US011480380B2

(12) United States Patent
Little et al.

(10) Patent No.: US 11,480,380 B2
(45) Date of Patent: Oct. 25, 2022

(54) TEMPERATURE CONTROLLED STORAGE DEVICE

(71) Applicants: James Little, Washington, DC (US); Laquita Worley, Washington, DC (US)

(72) Inventors: James Little, Washington, DC (US); Laquita Worley, Washington, DC (US)

( * ) Notice: Subject to any disclaimer, the term of this patent is extended or adjusted under 35 U.S.C. 154(b) by 237 days.

(21) Appl. No.: 16/935,876

(22) Filed: Jul. 22, 2020

(65) Prior Publication Data

US 2022/0026131 A1 Jan. 27, 2022

(51) Int. Cl.
*F25D 3/08* (2006.01)
*F25D 29/00* (2006.01)

(52) U.S. Cl.
CPC ..... *F25D 3/08* (2013.01); *F25D 29/00* (2013.01)

(58) Field of Classification Search
CPC ..... A47C 27/082; F25D 29/003; F25D 3/08
See application file for complete search history.

(56) References Cited

U.S. PATENT DOCUMENTS 2,723,535 A * 11/1955 Jones ..... F25D 3/08 280/DIG. 6
4,809,352 A 2/1989 Walker
D333,592 S 3/1993 Walker
6,018,960 A 2/2000 Parienti
6,658,857 B1 12/2003 George
7,513,510 B2 4/2009 Vanderberg
8,863,546 B2 10/2014 Oberweis
2007/0023439 A1* 2/2007 Vaughn ..... F25D 3/08 220/592.2
2016/0243000 A1* 8/2016 Gray ..... A61J 1/165
2017/0119116 A1* 5/2017 Bradley ..... A45C 13/008

FOREIGN PATENT DOCUMENTS

WO WO2007016092 2/2007

* cited by examiner

*Primary Examiner* — Schyler S Sanks

(57) ABSTRACT

A temperature controlled storage device for storing food and beverages includes a shell, which defines an interior space and is resiliently flexible. The shell comprises an inner layer and an outer layer that define an internal space, to which addition of air selectively inflates the shell from a collapsed configuration to a semirigid configuration. A top of the shell is reversibly couplable to opposing sides and a front of the shell so that the top is hingable relative to a back of the shell to allow access to the interior space. A closure that extends between the top of the shell and both the opposing sides and the front of the shell is positioned to selectively couple the top to the shell. A temperature control module that is coupled to and positioned in the shell selectively warms and cools the interior space and contents thereof.

18 Claims, 7 Drawing Sheets

TEMPERATURE CONTROLLED STORAGE DEVICE

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to storage devices and more particularly pertains to a new storage device for storing food and beverages.

(2) Description of Related Art Including Information Disclosed Under 37 CFR 1.97 and 1.98

The prior art relates to storage devices. Prior art inflatable storage devices may comprise bladders or interconnected tubes that define an interior space and a cooling means for cooling the interior space and contents thereof.

(h) BRIEF SUMMARY OF THE INVENTION

An embodiment of the disclosure meets the needs presented above by generally comprising a shell, which defines an interior space and is resiliently flexible. The shell comprises an inner layer and an outer layer that define an internal space, to which addition of air selectively inflates the shell from a collapsed configuration to a semirigid configuration, wherein the shell is substantially rectangularly box shaped. A top of the shell is reversibly couplable to opposing sides and a front of the shell so that the top is hingable relative to a back of the shell to allow access to the interior space. A closure that extends between the top of the shell and both the opposing sides and the front of the shell is positioned to selectively couple the top to the shell. A temperature control module that is coupled to and positioned in the shell is configured to selectively warm and cool the interior space and contents thereof.

There has thus been outlined, rather broadly, the more important features of the disclosure in order that the detailed description thereof that follows may be better understood, and in order that the present contribution to the art may be better appreciated.

There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
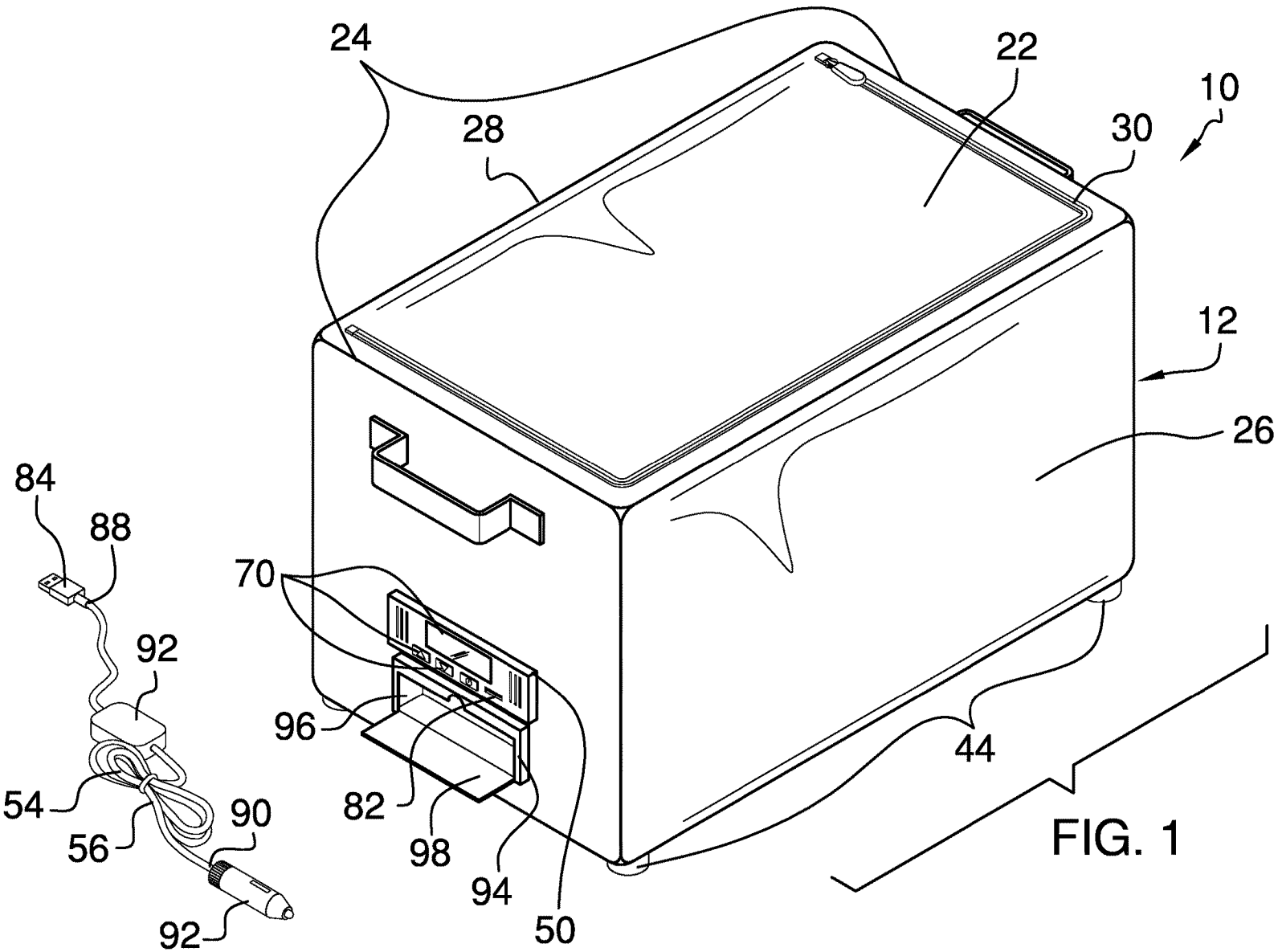
FIG. 1 is an isometric perspective view of a temperature controlled storage device according to an embodiment of the disclosure.

With reference now to the drawings, and in particular to FIGS. 1 through 7 thereof, a new storage device embodying the principles and concepts of an embodiment of the disclosure and generally designated by the reference numeral 10 will be described.

Figure 6:
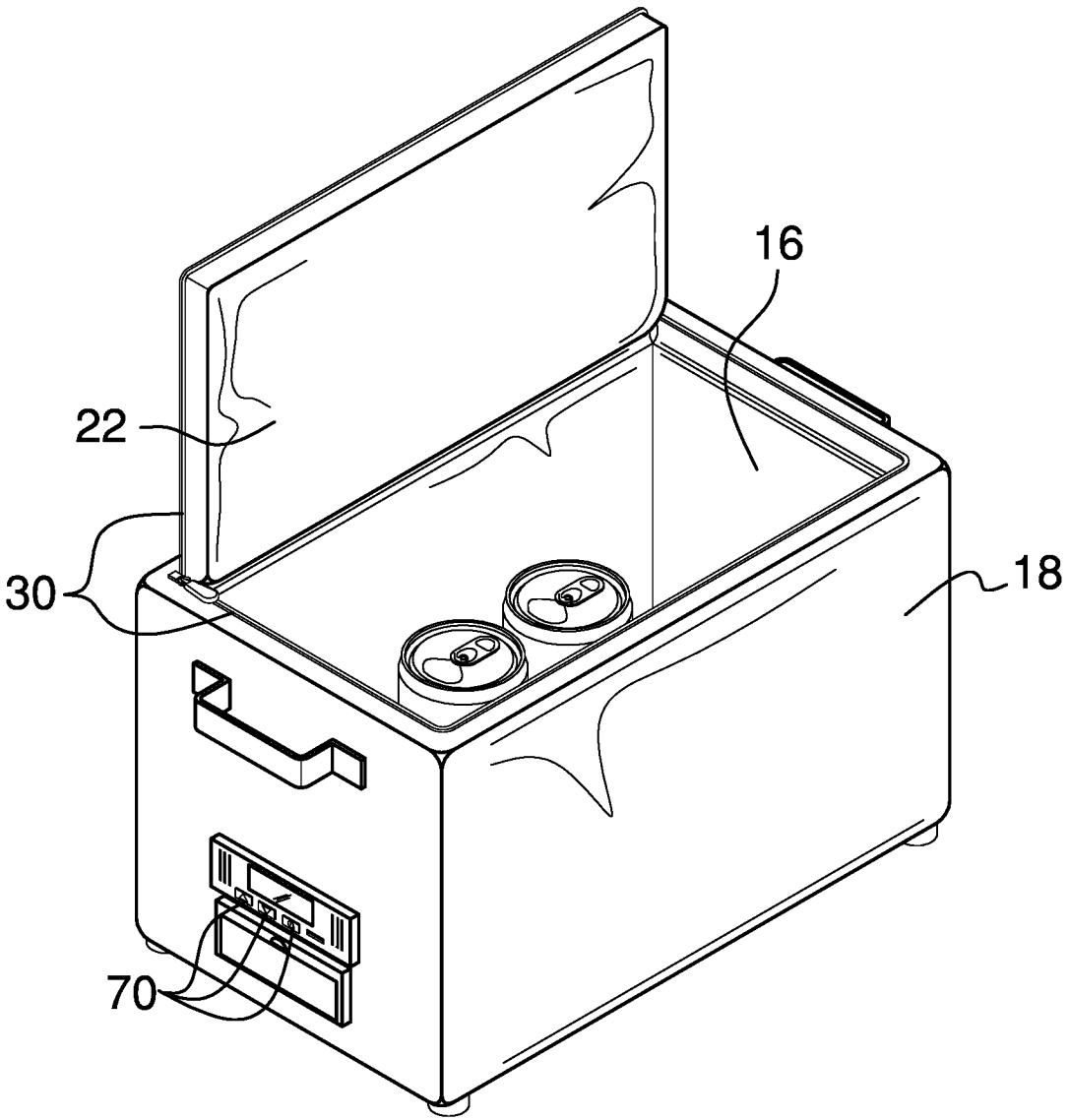
FIG. 6 is an in-use view of an embodiment of the disclosure.
Figure 7:
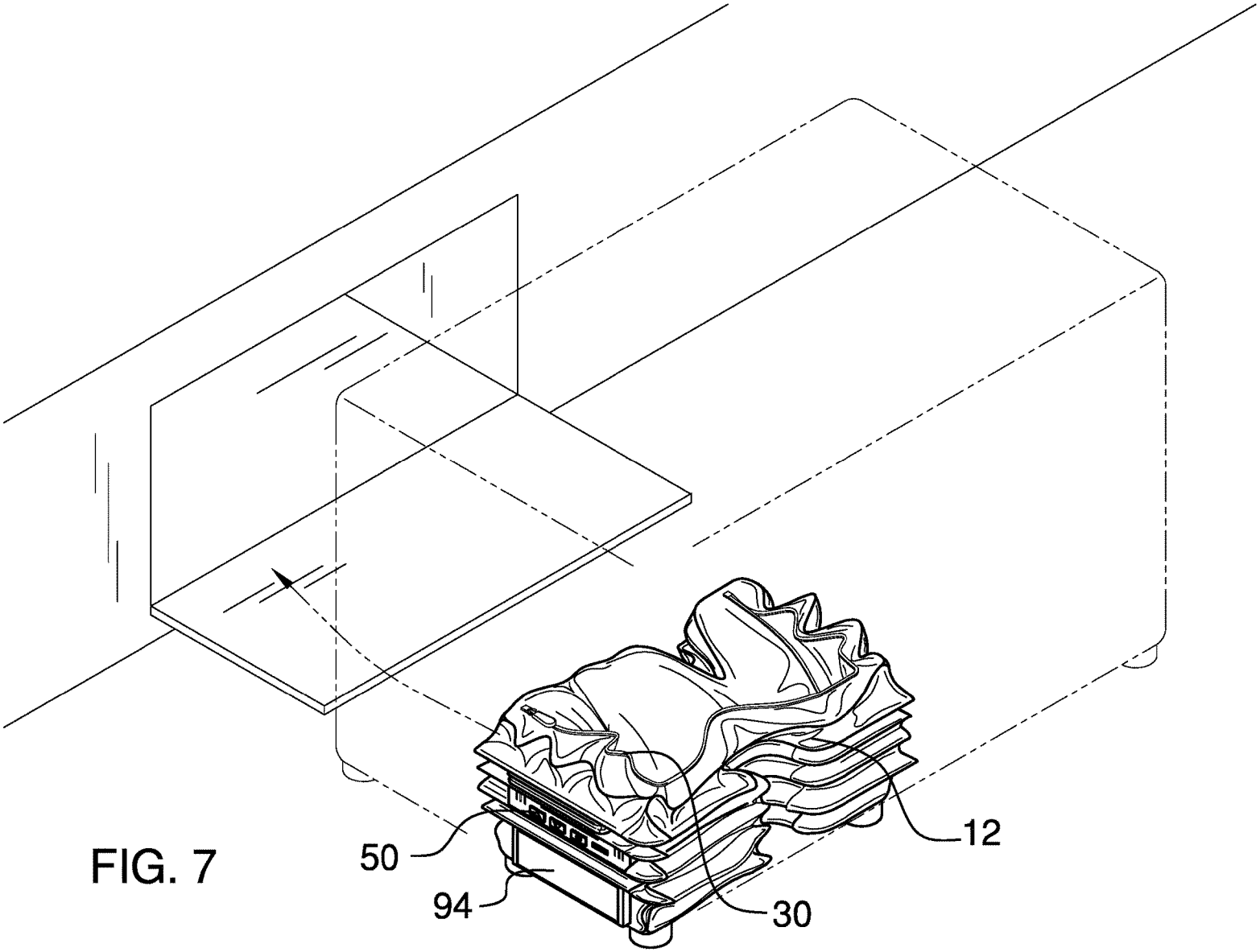
FIG. 7 is an isometric perspective view of an embodiment of the disclosure.

As best illustrated in FIGS. 1 through 7, the temperature controlled storage device 10 generally comprises a shell 12, which defines an interior space 14 and is resiliently flexible. The shell 12 comprises an inner layer 16 and an outer layer 18 that define an internal space 20. The shell 12 is configured for addition of air to the internal space 20 to selectively inflate the shell 12 from a collapsed configuration, as shown in FIG. 7, to a semirigid configuration, as shown in FIGS. 1-6, wherein the shell 12 is substantially rectangularly box shaped. The outer layer 18 may comprise canvas, or other protective material, such as, but not limited to, wire meshes, elastomers, and the like. The shell 12 in the collapsed configuration occupies substantially half the volume of the shell 12 in the semirigid configuration, allowing it to be readily stowed when not in use, as depicted in FIG. 7.

A top 22 of the shell 12 is reversibly couplable to opposing sides 24 and a front 26 of the shell 12 so that the top 22 is hingable relative to a back 28 of the shell 12 for accessing the interior space 14. A closure 30 that extends between the top 22 of the shell 12 and both the opposing sides 24 and the front 26 of the shell 12 is positioned to selectively couple the top 22 to the shell 12. The closure 30 may be zipper type, or other type, such as, but not limited to, hook and loop type, magnetic type, and the like.

A temperature control module 32 that is coupled to and positioned in the shell 12 is configured to selectively warm and cool the interior space 14 and contents thereof. The device 10 is anticipated to be stowable, in the collapsed configuration, in a designated compartment of a vehicle, such as a car, a truck, a boat, and the like. For example, the device 10 may be stowed in and selectively removable from a compartment in a trunk of a car. Thus, the device 10 would be available as needed to a user to maintain food and beverages at a desired temperature. After use, the device 10 can be cleaned and returned to the compartment until its use is again required. It is anticipated that the compartment would have positioned therein a connection to an electrical circuit of the vehicle, such as a cigarette lighter socket to provide power for the device 10.

The temperature control module 32 comprises at least one of a heat pump 34, a heating unit 36, and a cooling unit 38. The heating unit 36 may comprise a heating element 40, or other heating means, such as, but not limited to, heat lamps and the like. The cooling unit 38 is at least one of vapor compression type, sorption type, and thermoelectric type.

A pair of handles 42 is coupled to the shell 12. Each handle 42 is configured to be grasped in a respective hand of the user to lift the shell 12 and the contents thereof. The handles 42 are positioned singly on the opposing sides 24 of the shell 12.

A set of feet 44 is coupled singly proximate to corners 46 of a bottom 48 of the shell 12. The feet 44 are configured to stabilize the shell 12 on a surface and to elevate the bottom 48 of the shell 12 above the surface. The feet 44 may comprise plastic, or other substantially rigid material, such as, but not limited to, wood, metal, and the like.

A housing 50 is coupled to the shell 12. The temperature control module 32 is coupled to and positioned within the housing 50. The housing 50 extends through the shell 12 into the interior space 14 so that an outer face 52 of the housing 50 is substantially flush with the outer layer 18 of the shell 12 when the shell 12 is in the semirigid configuration.

A power module 54 is coupled to and positioned within the housing 50. The power module 54 is operationally coupled to the temperature control module 32. The power module 54 may comprise a power cord 56 that is configured to couple to a source of electrical current, or other powering means, such as, but not limited to, batteries and the like.

A pump 58 is coupled to and positioned within the housing 50. The pump 58 is operationally coupled to the power module 54. A set of openings 60 that is positioned in the outer face 52 of the housing 50 proximate to the pump 58 is configured for entry of air into the pump 58. A tube 62 is coupled to and extends between the pump 58 and the inner layer 16 of the shell 12 so that the pump 58 is fluidically coupled to the internal space 20. The pump 58 is configured to selectively pump air into the internal space 20 to inflate the shell 12 to the semirigid configuration.

A vent 64 that is positioned in the outer face 52 of the housing 50 proximate to the temperature control module 32 is configured for transfer of air between the temperature control module 32 and an ambient environment. A set of slots 66 that is positioned in an inner face 68 of the housing 50 proximate to the temperature control module 32 is configured for heat transfer between the temperature control module 32 and the interior space 14 to selectively heat and cool the interior space 14 and the contents thereof.

A controller 70 that is coupled to the housing 50 is operationally coupled to the power module 54, the temperature control module 32, and the pump 58 so that the controller 70 is positioned to selectively actuate the temperature control module 32 to selectively warm and cool the interior space 14 and the contents thereof. The controller 70 also is positioned to selectively actuate the pump 58 to pump air into the internal space 20 to inflate the shell 12.

The controller 70 comprises a display 72 that is configured to display at least one of a temperature measurement of the interior space 14 and a temperature setting for the interior space 14.

The controller 70 also comprises a temperature selector 74 that is configured to allow adjustment of the temperature setting for the interior space 14. The temperature selector 74 may comprise a first button 76 and a second button 78, or other selecting means, such as, but not limited to, dial selectors, touch pad selectors, and the like. The first button 76 and the second button 78 are depressible and are configured to be depressed to increase and decrease the temperature setting, respectively.

Figure 2:
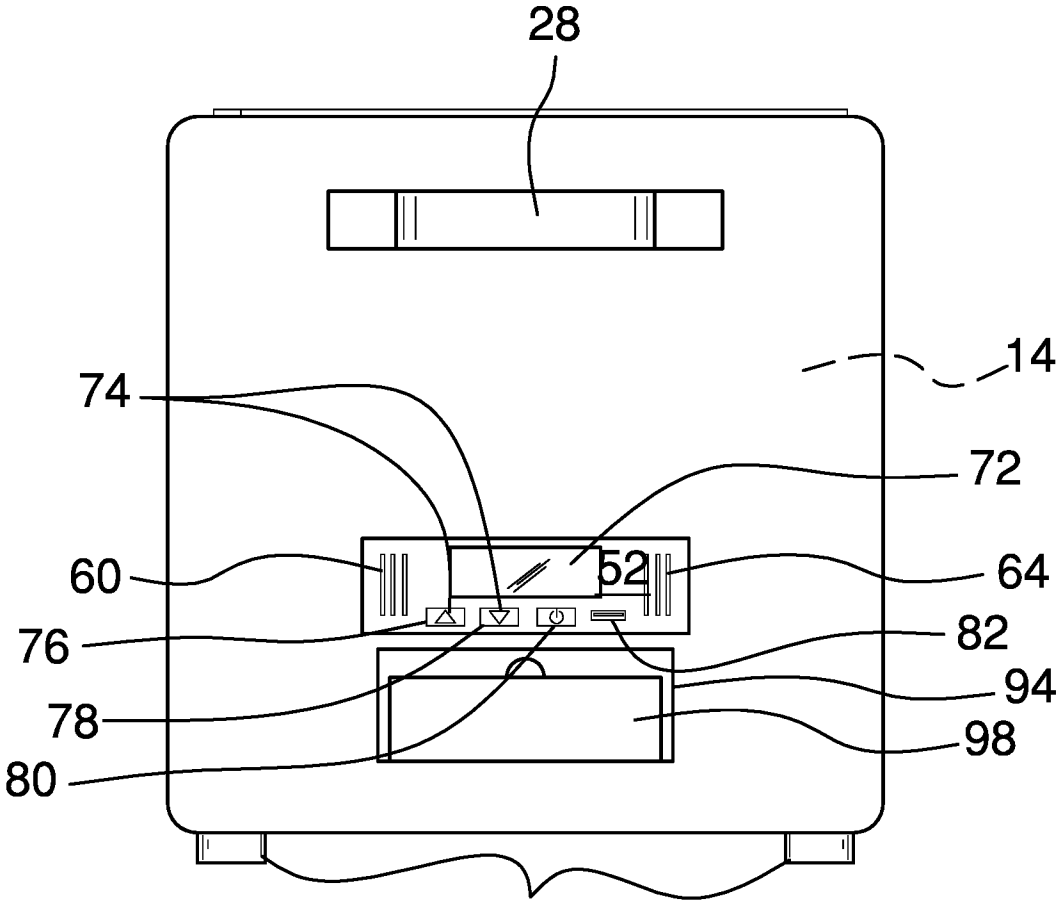
FIG. 2 is a side view of an embodiment of the disclosure.
Figure 3:
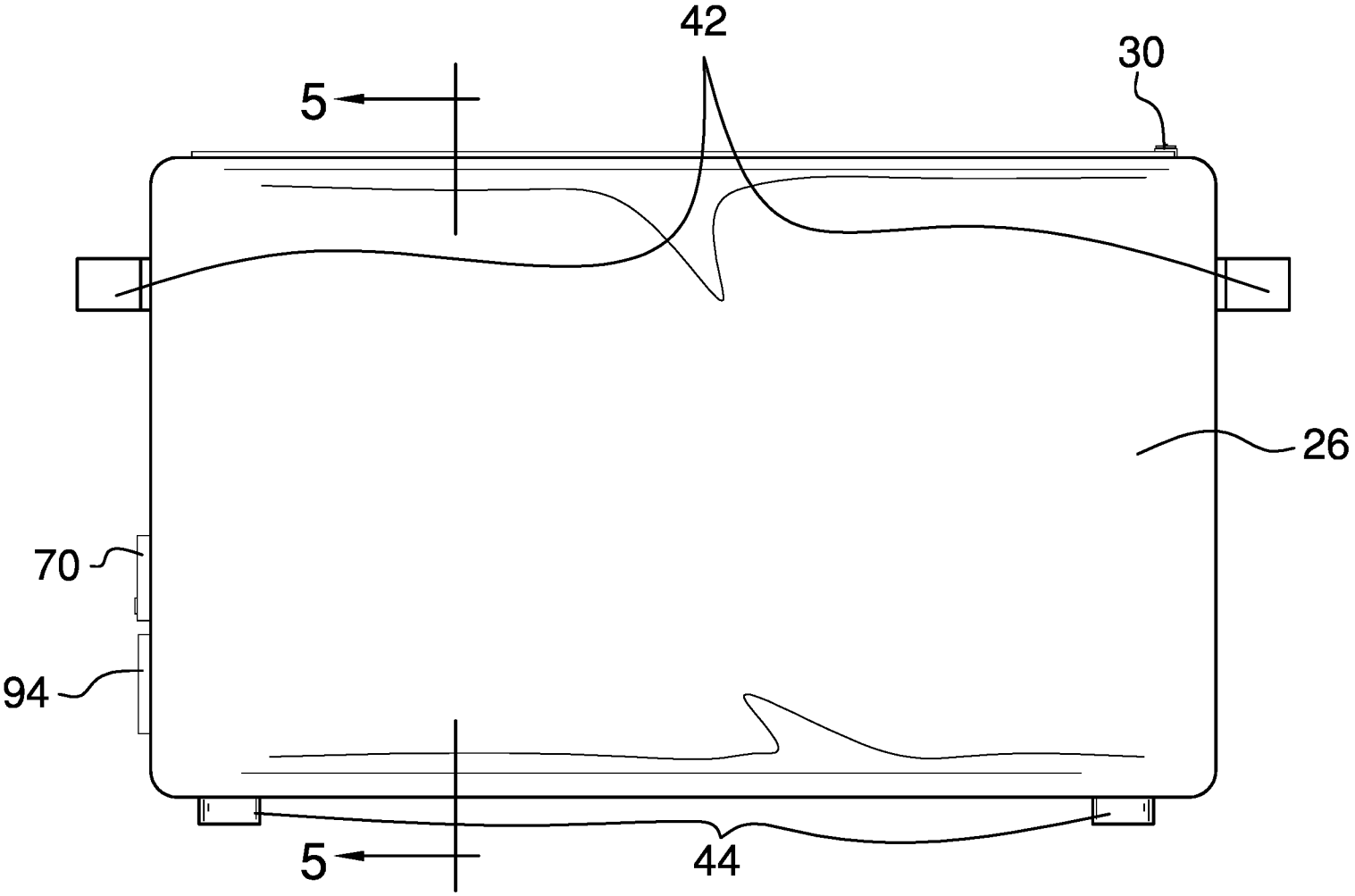
FIG. 3 is a front view of an embodiment of the disclosure.
Figure 4:
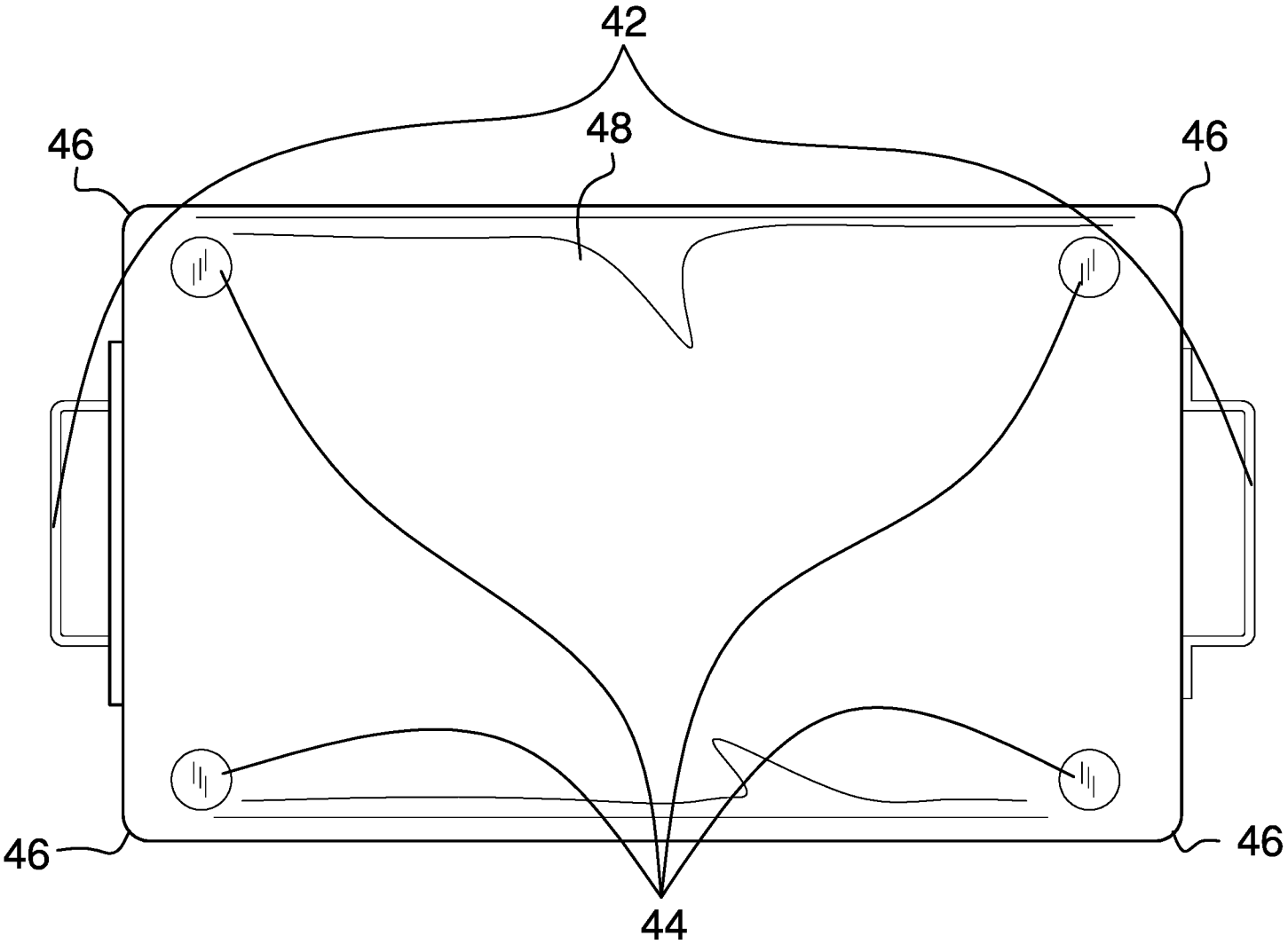
FIG. 4 is a bottom view of an embodiment of the disclosure.
Figure 5:
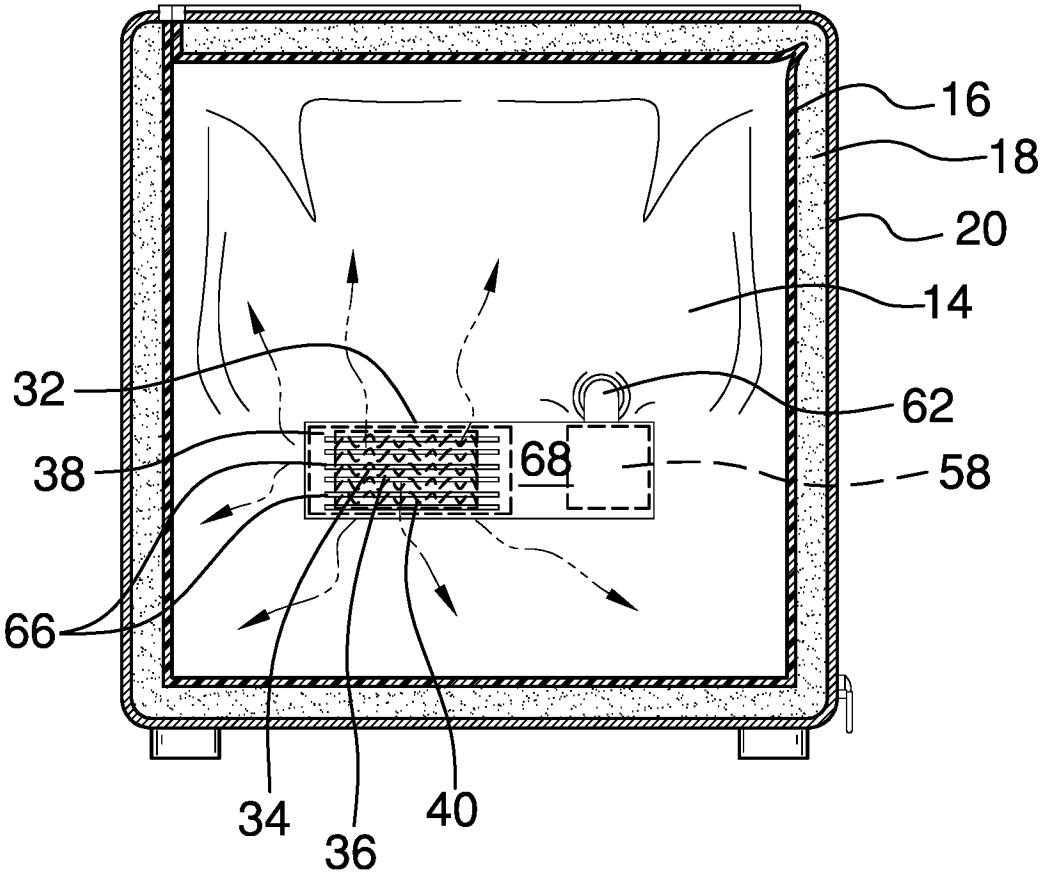
FIG. 5 is a cross-sectional view of an embodiment of the disclosure.

The controller 70 also comprises a switch 80 that is operationally coupled to the power module 54, the temperature control module 32, and the pump 58. The switch 80 is positioned to be selectively switched to power the temperature control module 32 and the pump 58. The switch 80 may be push button type, as shown in FIG. 2, or may be of another type, such as, but not limited to, toggle type, slide type, and the like.

A port 82 that is coupled to the housing 50 is operationally coupled to the controller 70. A first plug 84 and a second plug 86 are coupled to a first end 88 and a second end 90 of the power cord 56, respectively. The first plug 84 is complementary to the port 82 so that the first plug 84 is positioned to be selectively inserted into the port 82 to operationally couple the power cord 56 to the controller 70. The second plug 86 is configured to be inserted into a receptacle that is coupled to an electrical circuit to operationally couple the power cord 56 to the electrical circuit.

An electronic power converter 92 may be positioned in-line with the power cord 56. The electronic power converter 92 is configured to convert direct current of one voltage into direct current of another voltage. In such a configuration, the port 82 may be Universal Serial Bus type and the second plug 86 may be complementary to a cigarette lighter receptacle, as shown in FIG. 1.

A box 94 is coupled to the shell 12 proximate to the controller 70 and extends into the interior space 14. The box 94 has an exterior face 96 that is open so that the box 94 is positioned to stow the power cord 56 when not in use. A panel 98 that is hingedly coupled to the box 94 is selectively couplable to the box 94 to close the exterior face 96.

In use, the switch 80 is depressed to power the controller 70 and the pump 58, which forces air into the internal space 20 to inflate the shell 12 to the semirigid configuration. The user selectively depresses the first button 76 and the second button 78 to adjust the temperature setting for the interior space 14, which is visible on the display 72. The controller 70 actuates the temperature control module 32 to reach the temperature setting for the interior space 14. Articles, such as beverage cans as shown in FIG. 6, can be added to and removed from the interior space 14 by unzippering the top 22 of the shell 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

We claim:

1. A temperature controlled storage device comprising:

a shell defining an interior space, the shell comprising an inner layer and an outer layer defining an internal space, the shell being resiliently flexible wherein the shell is configured for addition of air to the internal space for selectively inflating the shell from a collapsed configuration to a semirigid configuration wherein the shell being is substantially rectangularly box shaped;

a top of the shell being reversibly couplable to opposing sides and a front of the shell such that the top is hingable relative to a back of the shell for accessing the interior space;

a closure extending between the top of the shell and both the opposing sides and the front of the shell and such that the closure is positioned for selectively coupling the top to the shell;

a temperature control module coupled to the shell and positioned in the interior space wherein the temperature control module is configured for selectively warming and cooling the interior space and contents thereof;

a housing coupled to the shell, the temperature control module being coupled to and positioned within the housing;

a power module coupled to and positioned within the housing, the power module being operationally coupled to the temperature control module;

a pump coupled to and positioned within the housing, the pump being operationally coupled to the power module;

a tube coupled to and extending between the pump and the inner layer of the shell such that the pump is fluidically coupled to the internal space wherein the pump is configured for selectively pumping air into the internal space for inflating the shell to the semirigid configuration;

a set of openings positioned in the outer face of the housing proximate to the pump wherein the set of openings is configured for entry of air into the pump;

a vent positioned in the outer face of the housing proximate to the temperature control module wherein the vent is configured for transfer of air between the temperature control module and an ambient environment;

a set of slots positioned in an inner face of the housing proximate to the temperature control module wherein the set of slots is configured for heat transfer between the temperature control module and the interior space for selectively heating and cooling the interior space and the contents thereof; and a controller coupled to the housing, the controller being operationally coupled to the power module, the temperature control module, and the pump such that the controller is positioned for selectively actuating the temperature control module for selectively warming and cooling the interior space and the contents thereof and for selectively actuating the pump for pumping air into the internal space for inflating the shell.

2. The device of claim 1, further including the outer layer comprising canvas.

3. The device of claim 1, further including the closure being a zipper.

4. The device of claim 1, further including the temperature control module comprising at least one of a heat pump, a heating unit, and a cooling unit.

5. The device of claim 4, further comprising:

the heating unit comprising a heating element; and the cooling unit being at least one of vapor compression type, sorption type, and thermoelectric type.

6. The device of claim 1, further including a pair of handles coupled to the shell wherein each handle is configured for grasping in a respective hand of a user for lifting the shell and the contents thereof.

7. The device of claim 6, further including the handles being positioned singly on the opposing sides of the shell.

8. The device of claim 1, further including a set of feet coupled singly proximate to corners of a bottom of the shell wherein the feet are configured for stabilizing the shell on a surface and for elevating the bottom of the shell above the surface.

9. The device of claim 8, further including the feet comprising plastic.

10. The device of claim 1, further including the housing extending through the shell into the interior space such that an outer face of the housing is substantially flush with the outer layer of the shell when the shell is in the semirigid configuration.

11. The device of claim 1, further including the controller comprising:

a display configured for displaying at least one of a temperature measurement of the interior space and a temperature setting for the interior space;

a temperature selector configured for adjusting the temperature setting for the interior space; and a switch operationally coupled to the power module, the temperature control module, and the pump such that the switch is positioned for being selectively switched for powering the temperature control module and the pump.

12. The device of claim 11, further comprising:

the temperature selector comprising a first button and a second button, the first button and the second button being depressible wherein the first button and the second button are configured for depressing for increasing and decreasing the temperature setting, respectively; and the switch being push button type.

13. The device of claim 1, further including the power module comprising a power cord wherein the power cord is configured for coupling to a source of electrical current.

14. The device of claim 13, further comprising:

a port coupled to the housing, the port being operationally coupled to the controller, a first plug coupled to a first end of the power cord, the first plug being complementary to the port such that the first plug is positioned for selectively inserting into the port for operationally coupling the power cord to the controller; and a second plug coupled to a second end of the power cord wherein the second plug is configured for inserting into a receptacle coupled to an electrical circuit for operationally coupling the power cord to the electrical circuit.

15. The device of claim 14, further comprising:

an electronic power converter positioned in-line with the power cord wherein the electronic power converter is configured for converting direct current of one voltage into direct current of another voltage;

the port being Universal Serial Bus type; and the second plug being complementary to a cigarette lighter receptacle.

16. The device of claim 14, further comprising:

a box coupled to the shell proximate to the controller and extending into the interior space, the box having an exterior face, the exterior face being open such that the box is positioned for stowing the power cord; and a panel hingedly coupled to the box, the panel being selectively couplable to the box for closing the exterior face.

17. The device of claim 1, further including the shell in the collapsed configuration occupying half the volume of the shell in the semirigid configuration.

18. A temperature controlled storage device comprising:

a shell defining an interior space, the shell comprising an inner layer and an outer layer defining an internal space, the shell being resiliently flexible wherein the shell is configured for addition of air to the internal space for selectively inflating the shell from a collapsed configuration to a semirigid configuration wherein the shell being is substantially rectangularly box shaped, the outer layer comprising canvas, the shell in the collapsed configuration occupying half the volume of the shell in the semirigid configuration;

a top of the shell being reversibly couplable to opposing sides and a front of the shell such that the top is hingable relative to a back of the shell for accessing the interior space;

a closure extending between the top of the shell and both the opposing sides and the front of the shell and such that the closure is positioned for selectively coupling the top to the shell, the closure being a zipper;

a temperature control module coupled to the shell and positioned in the interior space wherein the temperature control module is configured for selectively warming and cooling the interior space and contents thereof, the temperature control module comprising at least one of a heat pump, a heating unit, and a cooling unit, the heating unit comprising a heating element, the cooling unit being at least one of vapor compression type, sorption type, and thermoelectric type;

a pair of handles coupled to the shell Wherein each handle is configured for grasping in a respective hand of a user for lifting the shell and the contents thereof, the handles being positioned singly on the opposing sides of the shell;

a set of feet coupled singly proximate to corners of a bottom of the shell wherein the feet are configured for stabilizing the shell on a surface and for elevating the bottom of the shell above the surface, the feet comprising plastic;

a housing coupled to the shell, the temperature control module being coupled to and positioned within the housing, the housing extending through the shell into the interior space such that an outer face of the housing is substantially flush with the outer layer of the shell when the shell is in the semirigid configuration;

a power module coupled to and positioned within the housing, the power module being operationally coupled to the temperature control module, the power module comprising a power cord wherein the power cord is configured for coupling to a source of electrical current;

an electronic power converter positioned in-line with the power cord wherein the electronic power converter is configured for converting direct current of one voltage into direct current of another voltage;

a pump coupled to and positioned within the housing, the pump being operationally coupled to the power module;

a tube coupled to and extending between the pump and the inner layer of the shell such that the pump is fluidically coupled to the internal space wherein the pump is configured for selectively pumping air into the internal space for inflating the shell to the semirigid configuration;

a set of openings positioned in the outer face of the housing proximate to the pump wherein the set of openings is configured for entry of air into the pump;

a vent positioned in the outer face of the housing proximate to the temperature control module wherein the vent is configured for transfer of air between the temperature control module and an ambient environment;

a set of slots positioned in an inner face of the housing proximate to the temperature control module wherein the set of slots is configured for heat transfer between the temperature control module and the interior space for selectively heating and cooling the interior space and the contents thereof;

a controller coupled to the housing, the controller being operationally coupled to the power module, the temperature control module, and the pump such that the controller is positioned for selectively actuating the temperature control module for selectively warming and cooling the interior space and the contents thereof and for selectively actuating the pump for pumping air into the internal space for inflating the shell, the controller comprising:

a display configured for displaying at least one of a temperature measurement of the interior space and a temperature setting for the interior space;

a temperature selector configured for adjusting the temperature setting for the interior space, the temperature selector comprising a first button and a second button, the first button and the second button being depressible wherein the first button and the second button are configured for depressing for increasing and decreasing the temperature setting, respectively, and a switch operationally coupled to the power module, the temperature control module, and the pump such that the switch is positioned for being selectively switched for powering the temperature control module and the pump, the switch being push button type;

a port coupled to the housing, the port being operationally coupled to the controller, the port being Universal Serial Bus type;

a first plug coupled to a first end of the power cord, the first plug being complementary to the port such that the first plug is positioned for selectively inserting into the port for operationally coupling the power cord to the controller;

a second plug coupled to a second end of the power cord wherein the second plug is configured for inserting into a receptacle coupled to an electrical circuit for operationally coupling the power cord to the electrical circuit, the second plug being complementary to a cigarette lighter receptacle;

a box coupled to the shell proximate to the controller and extending into the interior space, the box having an exterior face, the exterior face being open such that the box is positioned for stowing the power cord; and a panel hingedly coupled to the box, the panel being selectively couplable to the box for closing the exterior face.

* * * * *